US011078443B2

(12) United States Patent
Saveyn et al.

(10) Patent No.: US 11,078,443 B2
(45) Date of Patent: Aug. 3, 2021

(54) FABRIC SOFTENER COMPOSITION

(71) Applicant: The Procter & Gamble Company, Cincinnati, OH (US)

(72) Inventors: Pieter Jan Maria Saveyn, Heusden (BE); Evelyne Johanna Lutgarde Vanhecke, Brussels (BE); Susana Fernandez Prieto, Brussels (BE); Johan Smets, Lubbeek (BE); Bruno Jean-Pierre Matthys, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 28 days.

(21) Appl. No.: 15/973,723

(22) Filed: May 8, 2018

(65) Prior Publication Data

US 2018/0334639 A1 Nov. 22, 2018

(30) Foreign Application Priority Data

May 18, 2017 (EP) ..... 17171724

(51) Int. Cl.

| | |
|---|---|
| ***C11D 3/00*** | (2006.01) |
| ***C11D 3/22*** | (2006.01) |
| ***C11D 3/30*** | (2006.01) |
| ***C11D 3/04*** | (2006.01) |
| ***C11D 3/36*** | (2006.01) |
| ***C11D 3/50*** | (2006.01) |
| ***C11D 11/00*** | (2006.01) |

(52) U.S. Cl.

CPC ..... *C11D 3/0015* (2013.01); *C11D 3/046* (2013.01); *C11D 3/222* (2013.01); *C11D 3/227* (2013.01); *C11D 3/30* (2013.01); *C11D 3/361* (2013.01); *C11D 3/505* (2013.01); *C11D 11/0017* (2013.01)

(58) Field of Classification Search

CPC .... C11D 3/00; C11D 3/22; C11D 3/30; C11D 11/00

See application file for complete search history.

(56) References Cited

U.S. PATENT DOCUMENTS 3,235,596 A * 2/1966 Nordgren ..... C08G 73/0206 106/316
3,397,970 A * 8/1968 Strickland ..... C10L 1/143 44/394
3,749,211 A * 7/1973 Cima ..... A45C 5/02 190/109
3,842,976 A * 10/1974 Dea ..... B65D 1/24 206/203
5,447,643 A * 9/1995 Kelkenberg ..... C11D 1/662 510/524
6,022,845 A * 2/2000 Avila-Garcia ..... C11D 1/835 510/101
6,207,601 B1 * 3/2001 Maurer ..... A24D 3/068 131/341
6,410,501 B1 * 6/2002 Jones ..... C11D 1/662 510/515
6,531,438 B1 * 3/2003 Littig ..... C11D 3/0015 510/322
6,790,815 B1 * 9/2004 Bettiol ..... C11D 3/001 510/101
6,875,735 B1 * 4/2005 Frankenbach ..... C11D 1/62 510/522
6,967,027 B1 * 11/2005 Heux ..... C08J 3/03 424/484
2001/0021692 A1 * 9/2001 Mohammadi ..... C11D 1/835 510/515
2003/0224965 A1 * 12/2003 Conley ..... D06F 58/203 512/1
2005/0202990 A1 * 9/2005 Caswell ..... A47F 1/08 510/295
2005/0256020 A1 * 11/2005 Gardner ..... B82Y 30/00 510/392
2008/0207481 A1 * 8/2008 Meine ..... C11D 3/50 512/4
2008/0242584 A1 * 10/2008 Wahl ..... C11D 3/227 510/517
2008/0305984 A1 * 12/2008 Ford ..... C11D 1/62 510/522
2009/0209661 A1 * 8/2009 Somerville Roberts ..... A61K 8/11 514/772.5
2009/0291876 A1 * 11/2009 Blanco ..... C11D 3/0015 510/522
2010/0056647 A1 * 3/2010 Graham ..... A61K 8/91 514/772.5

(Continued)

FOREIGN PATENT DOCUMENTS

KR 100419603 B1 2/2004
WO WO-9927050 A1 * 6/1999 ..... C11D 1/62

(Continued)

OTHER PUBLICATIONS

Extended European Search Report; Application No. 17171724.2-1358; dated Oct. 27, 2017; 5 pages.

(Continued)

*Primary Examiner* — Mark Eashoo
*Assistant Examiner* — M. R. Asdjodi
(74) *Attorney, Agent, or Firm* — Gregory S. Darley-Emerson

(57) ABSTRACT

A liquid fabric softener composition and processes for making and using same. In particular a liquid fabric softener composition comprising a structurant providing the desired viscosity which remains stable over time.

15 Claims, No Drawings

(56) References Cited

U.S. PATENT DOCUMENTS

2010/0292474 A1* 11/2010 Demeyere ..... C07D 233/22
544/335
2011/0245138 A1* 10/2011 Kohle ..... C07C 213/06
510/515
2011/0275553 A1* 11/2011 Leopold ..... C11D 1/62
510/516
2012/0142579 A1* 6/2012 Panandiker ..... C11D 1/62
510/516
2012/0220515 A1* 8/2012 Fernandes ..... C11D 17/0039
510/343
2015/0159119 A1* 6/2015 Fernandez-Prieto .... C11D 1/62
510/527
2015/0252312 A1* 9/2015 de Villeneuve .... C11D 17/0039
510/515
2016/0024432 A1* 1/2016 Sivik ..... C11D 3/001
8/137
2016/0024434 A1* 1/2016 Sivik ..... C11D 3/001
8/137
2016/0281034 A1* 9/2016 Panandiker ..... C11D 3/3742
2016/0348040 A1* 12/2016 Bianchetti ..... C11D 3/505
2017/0121639 A1* 5/2017 Zhang ..... C11D 1/66
2018/0179470 A1* 6/2018 Saveyn ..... C11D 3/0015
2018/0179473 A1* 6/2018 Saveyn ..... C11D 1/62
2018/0334639 A1* 11/2018 Saveyn ..... C11D 3/222

FOREIGN PATENT DOCUMENTS

WO WO2004061065 A1 7/2004
WO WO2008003453 A1 1/2008
WO WO-2011123606 A1 * 10/2011 ..... C11D 1/62

OTHER PUBLICATIONS

Payet, Linda et al.; Emulsification and Stabilization Mechanisms of O/W Emulsions in the Presence of Chitosan; Langmuir 2008; vol. 24; No. 21; pp. 12247-12252.

* cited by examiner

FABRIC SOFTENER COMPOSITION

FIELD OF THE INVENTION

Liquid fabric softener composition and processes for making and using same. In particular liquid fabric softener compositions having improved stability.

BACKGROUND OF THE INVENTION

The rheological properties of a liquid fabric softener composition are a critical aspect for its consumer acceptance, and can be critical for the phase stability of the composition. To provide a desired viscosity, fabric softener compositions often use the thickening properties of surfactant ingredients, added salts or incorporate structurants. Polymeric structurants can provide good structuring even when used at low levels.

Unfortunately, viscous liquid fabric softener compositions have a tendency to lose viscosity upon product ageing. Both viscosity loss and poor phase stability have a negative impact on the consumer perceived product efficacy. Many of the various solutions to these problems have not been completely satisfactory. Hence, there is still a need for a liquid fabric softener composition comprising a structurant providing stable viscosity and good phase stability over time.

WO2008003453 (Clariant) relates to a softener composition comprising an esterquat. Optionally, the composition may comprise salt(s) in order to improve the stability of the composition over time. KR100419603 (Artech Plus) relates to a softener composition comprising a quaternary ammonium-type softening agent, a polyvinyl alcohol salt dispersant, perfume capsules and chitosan.

SUMMARY OF THE INVENTION

The present invention relates to a liquid fabric softener composition, comprising, based on weight of the fabric softener composition weight: from 2% to 25% of fabric softening active and from 0.01% to 1% of chitosan; from 0.002% to 2% of salt selected from the group consisting of alkaline metals salts, alkaline earth metal salts of the mineral acids, and combinations thereof.

A synergistic effect between the salt and chitosan in a liquid fabric softener composition has been surprisingly found. This effect results in less viscosity loss for said composition over time compared to using conventional structurants in a liquid fabric softener composition. The liquid fabric softener composition of the present invention comprising salt and chitosan exhibits good softening performance, improved phase stability and viscosity stability.

One other aspect of the invention is the use of a combination of salt and chitosan in a liquid fabric softener composition to provide improved stability or viscosity.

DETAILED DESCRIPTION OF THE INVENTION

Definitions

As used herein, articles such as "a" and "an" when used in a claim, are understood to mean one or more of what is claimed or described.

As used herein, the terms "include", "includes" and "including" are meant to be non-limiting.

As used herein, the term "fluid" includes liquid and gel product forms.

As used herein, the term "situs" includes paper products, fabrics and garments.

As used herein, the term "perfume oil", refers to volatile oils comprising one or more perfume raw materials (PRMs) and optional solvents, in which no chemical compounds are intentionally added to combine or react with the PRMs, and therefore the PRMs are free to become volatized and available for olfactory detection by a user.

As used herein, the term "perfume delivery technology" refers to the combinations or reaction product of PRMs with certain chemical compounds, which enhances the deposition efficiency of the perfume onto a situs and/or a controlled release of the perfume.

As used herein, the term "conventional structurant" refers to structurants commonly used in liquid fabric softener compositions and commercially available, for example Rheovis CDE (supplier BASF), Flosoft FS222 (supplier SNF), Jaypol 213 (supplier Ashland) or Rheosolve 450 (supplier Coatex) but not chitosan. Further examples of conventional structurants can be found in WO 2004/61065, WO 99/06455 A, WO 2004/050812 A1 and WO 2013/016029 A1.

Unless otherwise noted, all component or composition levels are in reference to the active portion of that component or composition, and are exclusive of impurities, for example, residual solvents or by-products, which may be present in commercially available sources of such components or compositions.

All percentages and ratios are calculated by weight unless otherwise indicated. All percentages and ratios are calculated based on the total composition unless otherwise indicated.

All measurements are performed at 25° C. unless otherwise specified.

Liquid Fabric Softener Composition

To obtain liquid fabric softener compositions of satisfactory hydrolytic stability, the liquid fabric softener composition of the present invention may have a pH of from 2 to 5, preferably from 2 to 4, more preferably from 2 to 3.5. The pH is measured on the neat composition, at 25° C., using a Sartarius PT-10P pH meter with gel-filled probe (such as the Toledo probe, part number 52 000 100), calibrated according to the instructions manual.

The liquid fabric softener composition of the present invention may have a viscosity of from 50 mPa·s to 800 mPa·s, preferably 70 mPa·s to 600 mPa·s, more preferably 100 mPa·s to 400 mPa·s (see Methods).

To obtain liquid fabric softener compositions of improved phase stability, the dynamic yield stress (see Methods) at 20° C. of the liquid fabric softener composition may be from 0.001 Pa to 1.0 Pa, preferably from 0.005 Pa to 0.8 Pa, more preferably from 0.01 Pa to 0.5 Pa. The absence of a dynamic yield stress may lead to phase instabilities such as particle creaming or settling in case the fabric softener composition comprises suspended particles such as benefit agent benefit agent capsules. Very high dynamic yield stresses may lead to undesired air entrapment during filling of a bottle with the fabric softener composition.

Fabric Softening Active

The liquid fabric softener composition of the present invention comprises from 2% to 25%, preferably from 3% to 20%, more preferably from 4% to 15% of fabric softening active ("FSA"). Suitable fabric softening actives, include, but are not limited to, materials selected from the group consisting of quaternary ammonium compounds, amines, fatty esters, sucrose esters, silicones, dispersible polyolefins, polysaccharides, fatty acids, softening oils, polymer latexes and combinations thereof.

Quaternary Ammonium Compounds

Preferably, fabric softening active are selected from the group consisting of quaternary ammonium compounds and mixtures thereof. In particular ester quats are preferred because of their biodegradable nature.

Suitable quaternary ammonium compounds (quats) include but are not limited to, materials selected from the group consisting of ester quats, amide quats, imidazoline quats, alkyl quats, amidoester quats and combinations thereof. Suitable ester quats include but are not limited to, materials selected from the group consisting of monoester quats, diester quats, triester quats and combinations thereof.

To maintain odor stability of the liquid fabric softener composition whilst improving processability of the quaternary ammonium compound, the iodine value (IV) of the parent fatty acyl compound or acid from which the alkyl or, alkenyl chains are derived is from 0 to 60, preferably from 12 to 58, more preferably from 18 to 56.

If there is any unsaturated quaternary ammonium compound present in the composition, the iodine value, referred to above, represents the mean iodine value of the parent fatty acyl compounds or fatty acids of all of the quaternary ammonium compound present.

Said fabric softening active may comprise compounds of the following formula:

$$\{R^2_{(4-m)}—N+—[X—Y—R^1]_m\}A^-$$

wherein:

m is 1, 2 or 3 with proviso that the value of each m is identical;

each $R^1$ is independently hydrocarbyl, or branched hydrocarbyl group, preferably $R^1$ is linear, more preferably $R^1$ is partially unsaturated linear alkyl chain;

each $R^2$ is independently a $C_1$-$C_3$ alkyl or hydroxyalkyl group, preferably $R^2$ is selected from methyl, ethyl, propyl, hydroxyethyl, 2-hydroxypropyl, 1-methyl-2-hydroxyethyl, poly($C_2$-$C_3$ alkoxy), polyethoxy, benzyl;

each X is independently $—(CH_2)_n—$, $—CH_2—CH(CH_3)—$ or $—CH—(CH_3)—CH_2—$ and each n is independently 1, 2, 3 or 4, preferably each n is 2;

each Y is independently —O—(O)C— or —C(O)—O—;

A− is independently selected from the group consisting of chloride, methyl sulfate, and ethyl sulfate, preferably $A^-$ is selected from the group consisting of chloride and methyl sulfate, more preferably A− is methyl sulfate;

with the proviso that when Y is —O—(O)C—, the sum of carbons in each $R^1$ is from 13 to 21, preferably from 13 to 19. Preferably, X is $—CH_2—CH(CH_3)—$ or $—CH—(CH_3)—CH_2—$ to improve the hydrolytic stability of the quaternary ammonium ester softening active, and hence further improve the stability of the fabric softener composition.

Examples of suitable quaternary ammonium ester softening actives are commercially available from Evonik under the tradename Rewoquat WE18, Rewoquat WE20, from Stepan under the tradename Stepantex GA90, Stepantex VK90, Stepantex VL90A.

These types of agents and general methods of making them are disclosed in U.S. Pat. No. 4,137,180.

A second type of suitable fabric softening active has the formula:

$$[R_{4-m}—N^+—R^1{}_m]A^- \quad (2)$$

wherein each R, $R^1$, m and $A^-$ have the same meanings as before.

Non-limiting examples of fabric softening actives comprising formula (2) include dialkylenedimethylammonium salts such as dicanoladimethylammonium chloride, di(hard) tallowdimethylammonium chloride, dicanoladimethylammonium methylsulfate, and combinations thereof. An example of commercially available dialkylenedimethylammonium salts usable in the present invention is dioleyldimethylammonium chloride available from Witco Corporation under the trade name Adogen® 472 and dihardtallow dimethylammonium chloride available from Akzo Nobel Arquad 2HT75.

A suitable ester quat is the reaction product of methyldiethanolamine with fatty acids, in molar ratio ranging from 1:1.5 to 1:2, fully or partially quaternized with methylchloride or dimethylsulphate. In another aspect, the ester quat is the reaction product of tri-ethanolamine with fatty acids, mixed in a molar ratio ranging from 1:1.5 to 1:2.1, fully or partially quaternized with dimethylsulphate. In a third aspect, the suitable ester quat is the reaction product of methyl-diethanolamine with fatty acids, fully or partially quaternized with dimethylsulphate. In a fourth aspect, the suitable ester quat is the reaction product of methyldiisopropanolamine with fatty acids, in molar ratio ranging from 1:1.5 to 1:2, fully or partially quaternized with dimethylsulphate.

In these four cases, the fatty acid contains 8-24 carbon atoms.

Amines

Suitable amines include but are not limited to, materials selected from the group consisting of amidoesteramines, amidoamines, imidazoline amines, alkyl amines, and combinations thereof. Suitable ester amines include but are not limited to, materials selected from the group consisting of monoester amines, diester amines, triester amines and combinations thereof. Suitable amidoamines include but are not limited to, materials selected from the group consisting of monoamido amines, diamido amines and combinations thereof. Suitable alkyl amines include but are not limited to, materials selected from the group consisting of mono alkylamines, dialkyl amines quats, trialkyl amines, and combinations thereof.

Fatty Acid

The liquid fabric softener composition may comprise a fatty acid, such as a free fatty acid as fabric softening active. The term "fatty acid" is used herein in the broadest sense to include unprotonated or protonated forms of a fatty acid. One skilled in the art will readily appreciate that the pH of an aqueous composition will dictate, in part, whether a fatty acid is protonated or unprotonated. The fatty acid may be in its unprotonated, or salt form, together with a counter ion, such as, but not limited to, calcium, magnesium, sodium, potassium, and the like. The term "free fatty acid" means a fatty acid that is not bound to another chemical moiety (covalently or otherwise).

The fatty acid may include those containing from 12 to 25, from 13 to 22, or even from 16 to 20, total carbon atoms, with the fatty moiety containing from 10 to 22, from 12 to 18, or even from 14 (mid-cut) to 18 carbon atoms.

The fatty acids may be derived from (1) an animal fat, and/or a partially hydrogenated animal fat, such as beef tallow, lard, etc.; (2) a vegetable oil, and/or a partially hydrogenated vegetable oil such as canola oil, safflower oil, peanut oil, sunflower oil, sesame seed oil, rapeseed oil, cottonseed oil, corn oil, soybean oil, tall oil, rice bran oil, palm oil, palm kernel oil, coconut oil, other tropical palm oils, linseed oil, tung oil, etc.; (3) processed and/or bodied oils, such as linseed oil or tung oil via thermal, pressure, alkali-isomerization and catalytic treatments; (4) combinations thereof, to yield saturated (e.g. stearic acid), unsaturated (e.g. oleic acid), polyunsaturated (linoleic acid), branched (e.g. isostearic acid) or cyclic (e.g. saturated or unsaturated α-disubstituted cyclopentyl or cyclohexyl derivatives of polyunsaturated acids) fatty acids.

Mixtures of fatty acids from different fat sources can be used.

The cis/trans ratio for the unsaturated fatty acids may be important, with the cis/trans ratio (of the C18:1 material) being from at least 1:1, at least 3:1, from 4:1 or even from 9:1 or higher.

Branched fatty acids such as isostearic acid are also suitable since they may be more stable with respect to oxidation and the resulting degradation of color and odor quality. The fatty acid may have an iodine value from 0 to 140, from 50 to 120 or even from 85 to 105.

Sucrose Esters

The liquid fabric softener composition may comprise a sucrose esters as a fabric softening active. Sucrose esters are typically derived from sucrose and fatty acids. Sucrose ester is composed of a sucrose moiety having one or more of its hydroxyl groups esterified.

Sucrose is a disaccharide having the following formula:

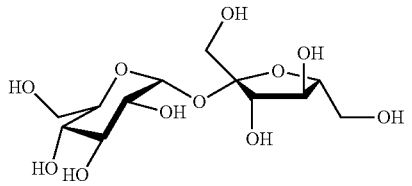

Alternatively, the sucrose molecule can be represented by the formula: $M(OH)_8$, wherein M is the disaccharide backbone and there are total of 8 hydroxyl groups in the molecule.

Thus, sucrose esters can be represented by the following formula:

$$M(OH)_{8-x}(OC(O)R^1)_x$$

wherein x is the number of hydroxyl groups that are esterified, whereas (8-x) is the hydroxyl groups that remain unchanged; x is an integer selected from 1 to 8, alternatively from 2 to 8, alternatively from 3 to 8, or from 4 to 8; and $R^1$ moieties are independently selected from $C_1$-$C_{22}$ alkyl or $C_1$-$C_{30}$ alkoxy, linear or branched, cyclic or acyclic, saturated or unsaturated, substituted or unsubstituted.

The $R^1$ moieties may comprise linear alkyl or alkoxy moieties having independently selected and varying chain length. For example, $R^1$ may comprise a mixture of linear alkyl or alkoxy moieties wherein greater than 20% of the linear chains are $C_{18}$, alternatively greater than 50% of the linear chains are $C_{18}$, alternatively greater than 80% of the linear chains are $C_{18}$.

The $R^1$ moieties may comprise a mixture of saturated and unsaturated alkyl or alkoxy moieties. The iodine value (IV) of the sucrose esters suitable for use herein ranges from 1 to 150, or from 2 to 100, or from 5 to 85. The $R^1$ moieties may be hydrogenated to reduce the degree of unsaturation. In the case where a higher IV is preferred, such as from 40 to 95, then oleic acid and fatty acids derived from soybean oil and canola oil are suitable starting materials.

The unsaturated $R^1$ moieties may comprise a mixture of "cis" and "trans" forms the unsaturated sites. The "cis"/"trans" ratios may range from 1:1 to 50:1, or from 2:1 to 40:1, or from 3:1 to 30:1, or from 4:1 to 20:1.

Silicone

The liquid fabric softener composition may comprise a silicone as fabric softening active. Useful silicones can be any silicone comprising compound. The silicone polymer may be selected from the group consisting of cyclic silicones, polydimethylsiloxanes, aminosilicones, cationic silicones, silicone polyethers, silicone resins, silicone urethanes, and combinations thereof. The silicone may be a polydialkylsilicone, alternatively a polydimethyl silicone (polydimethyl siloxane or "PDMS"), or a derivative thereof. The silicone may be chosen from an aminofunctional silicone, amino-polyether silicone, alkyloxylated silicone, cationic silicone, ethoxylated silicone, propoxylated silicone, ethoxylated/propoxylated silicone, quaternary silicone, or combinations thereof.

Chitosan

The liquid fabric softener composition comprises from 0.01% to 1% of chitosan, based on the weight of the liquid fabric softener composition.

Chitosan is a natural or modified polymer, typically derived as a by-product of processing shellfish (shrimps, crabs, squid, lobster, and the like). Chitosan typically has a pKa of from 5.5 to 6.5. When the composition pH is lower than the pKa of the chitosan, the chitosan is cationic.

The chitosan of use in the present invention may have the formula:

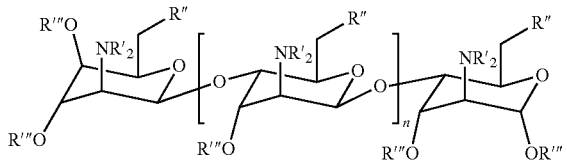

wherein R' is an end group selected from the group consisting of:

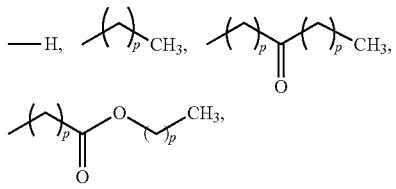

preferably:

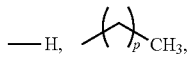

wherein R" is selected from the group consisting of:

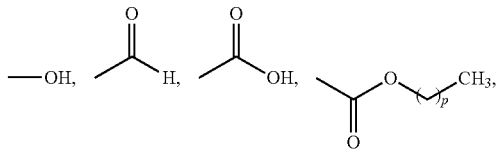

-continued

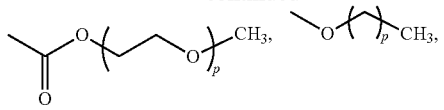

preferably:

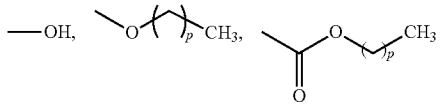

wherein R''' is selected from the group consisting of:

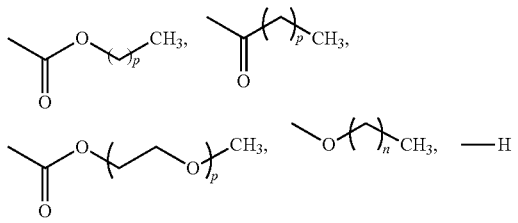

preferably:

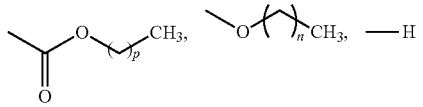

and wherein p is an integer from 0 to 45 and n is an integer from 60 to 12,500.

To improve phase and/or viscosity of the liquid fabric softener composition of the present invention, the chitosan of the present invention may have a molecular weight from 10,000 g/mol to 4,000,000 g/mol, preferably from 70,000 g/mol to 1,600,000 g/mol. Preferably, the chitosan of the present invention may have a molecular weight of at least about 100,000 g/mol.

The chitosan of the present invention may have a degree of de-acetylation of at least 50%, preferably at least 60%, more preferably at least 70%, even more preferably at least 75%.

Preferably, the chitosan of the present invention may have a molecular weight of at least 10,000 g/mol and a degree of deacetylation of at least 60%, preferably at least 10,000 g/mol and a degree of deacetylation of at least 70%, more preferably a degree of deacetylation of at least 75% and a molecular weight of at least 100,000 g/mol, even more preferably a degree of deacetylation of at least 75% and a molecular weight of at least 500,000 g/mol.

Chitosan of the present invention may be added separately, dispersed in an aqueous solution, or together with other materials of the liquid softener composition.

Salt

The liquid fabric softener composition, based on the weight of the liquid fabric softener composition, comprises from 0.002% to 2%, preferably from 0.005% to 0.5%, more preferably 0.01% to 0.3% of salt selected from the group consisting of alkaline metals salts, alkaline earth metal salts of the mineral acids and combinations thereof. Preferably, the liquid fabric softener composition comprises, based on the weight of the liquid fabric softener composition from 0.002% to 2%, preferably from 0.005% to 0.5%, more preferably 0.01% to 0.3% of said salt selected from the group consisting of $CaCl_2$, NaCl, $MgCl_2$ and combinations thereof, preferably $CaCl_2$ and $MgCl_2$, more preferably $CaCl_2$.

Particles

The liquid fabric softener composition of the present invention is also useful to suspend particles whilst maintaining phase stability. The liquid fabric softener composition may comprise, based on the weight of the liquid fabric softener composition, from 0.02% to 5%, preferably from 0.1% to 4%, more preferably from 0.25% to 2.5% of particles. Said particles are selected from the group consisting of beads, encapsulated benefit agent, pearlescent agents and combinations thereof. Encapsulated benefit agents are preferred.

Encapsulated Benefit Agent

The liquid fabric softener composition may comprise encapsulated benefit agents. Capsules encapsulating benefit agent comprise an outer shell defining an inner space in which a benefit agent is held until rupture of the shell.

The shell of the capsules may include a shell material comprising a material selected from the group consisting of polyethylenes; polyamides; polystyrenes; polyisoprenes; polycarbonates; polyesters; polyacrylates; acrylics; aminoplasts, preferably melamine-formaldehyde; polyolefins; polysaccharides, such as alginate and/or chitosan; gelatin; shellac; epoxy resins; vinyl polymers; water insoluble inorganics; silicone; and mixtures thereof. Preferably the shell material comprises polyacrylate to reduce leakage from the capsules.

Preferably the shell may comprise one or more multifunctional acrylate moieties. The multifunctional acrylate moiety may be selected from the group consisting of tri-functional acrylate, tetra-functional acrylate, penta-functional acrylate, hexa-functional acrylate, hepta-functional acrylate and mixtures thereof. The multifunctional acrylate moiety is preferably hexa-functional acrylate. The shell may include a polyacrylate that comprises a moiety selected from the group consisting of an acrylate moiety, methacrylate moiety, amine acrylate moiety, amine methacrylate moiety, a carboxylic acid acrylate moiety, carboxylic acid methacrylate moiety and combinations thereof, preferably an amine methacrylate or carboxylic acid acrylate moiety.

The shell may include a material that comprises one or more multifunctional acrylate and/or methacrylate moieties. The ratio of material that comprises one or more multifunctional acrylate moieties to material that comprises one or more methacrylate moieties may be from about 999:1 to about 6:4, preferably from about 99:1 to about 8:1, more preferably from about 99:1 to about 8.5:1.

The core/shell capsule may comprise an emulsifier, wherein the emulsifier is preferably selected from anionic emulsifiers, nonionic emulsifiers, cationic emulsifiers or mixtures thereof, preferably nonionic emulsifiers.

The core/shell capsule may comprise from 0.1% to 1.1% by weight of the core/shell capsule of polyvinyl alcohol. Preferably, the polyvinyl alcohol has at least one the following properties, or a mixture thereof:

(i) a hydrolysis degree from 55% to 99%;

(ii) a viscosity of from 40 mPa·s to 120 mPa·s in 4% water solution at 20° C.;

(iii) a degree of polymerization of from 1,500 to 2,500;

(iv) number average molecular weight of from 65,000 Da to 110,000 Da.

The core/shell capsule may comprise an emulsifier, wherein the emulsifier is preferably selected from styrene maleic anhydride monomethylmaleate, and/or a salt thereof, in one aspect, styrene maleic anhydride monomethylmaleate di-sodium salt and/or styrene maleic anhydride monomethylmaleate ammonia-salt; in one aspect, styrene maleic anhydride monomethylmaleate, and/or a salt thereof.

Perfume compositions are the preferred encapsulated benefit agent. The perfume composition comprises perfume raw materials. The encapsulated benefit agent may further comprise essential oils, malodour reducing agents, odour controlling agents, silicone, and combinations thereof.

The perfume raw materials are typically present in an amount of from 10% to 95%, preferably from 20% to 90% by weight of the capsule.

The perfume composition may comprise from 2.5% to 30%, preferably from 5% to 30% by weight of perfume composition of perfume raw materials characterized by a log P lower than 3.0, and a boiling point lower than 250° C.

The perfume composition may comprise from 5% to 30%, preferably from 7% to 25% by weight of perfume composition of perfume raw materials characterized by having a log P lower than 3.0 and a boiling point higher than 250° C. The perfume composition may comprise from 35% to 60%, preferably from 40% to 55% by weight of perfume composition of perfume raw materials characterized by having a log P higher than 3.0 and a boiling point lower than 250° C. The perfume composition may comprise from 10% to 45%, preferably from 12% to 40% by weight of perfume composition of perfume raw materials characterized by having a log P higher than 3.0 and a boiling point higher than 250° C.

Preferably, the core also comprises a partitioning modifier. Suitable partitioning modifiers include vegetable oil, modified vegetable oil, propan-2-yl tetradecanoate and mixtures thereof. The modified vegetable oil may be esterified and/or brominated. The vegetable oil comprises castor oil and/or soy bean oil. The partitioning modifier may be propan-2-yl tetradecanoate. The partitioning modifier may be present in the core at a level, based on total core weight, of greater than 20%, or from greater than 20% to about 80%, or from greater than 20% to about 70%, or from greater than 20% to about 60%, or from about 30% to about 60%, or from about 30% to about 50%.

Preferably the core/shell capsule have a volume weighted mean particle size from 0.5 microns to 100 microns, preferably from 1 micron to 60 microns, even more preferably from 5 microns to 30 microns.

Dispersed Perfume Oil

The liquid fabric softener composition may comprise, based on the weight of the liquid fabric softener composition, from 0.1% to 6%, preferably from 0.2% to 4%, more preferably from 0.3% to 3.5% of a dispersed perfume oil. By dispersed perfume we herein mean a perfume composition that is freely dispersed in the fabric softener composition and is not encapsulated. Perfume is typically added to provide the fabric softener composition with a pleasant smell.

Ratio of Perfume Oil Encapsulates to Dispersed Perfume Oil

The liquid fabric softener composition may comprise a ratio of perfume oil encapsulates to dispersed perfume oil of from 1:1 to 1:40, preferably from 1:2 to 1:20, more preferably from 1:3 to 1:10.

Further Perfume Delivery Technologies

The liquid fabric softener composition may comprise one or more perfume delivery technologies, that stabilize and enhance the deposition and release of perfume ingredients from treated substrate. Such perfume delivery technologies can also be used to increase the longevity of perfume release from the treated substrate. Perfume delivery technologies, methods of making certain perfume delivery technologies and the uses of such perfume delivery technologies are disclosed in US 2007/0275866 A1.

The liquid fabric softener composition may comprise from 0.001% to 20%, or from 0.01% to 10%, or from 0.05% to 5%, or even from 0.1% to 0.5% by weight of the perfume delivery technology. Said perfume delivery technologies may be selected from the group consisting of: pro-perfumes, cyclodextrins, starch encapsulated accord, zeolite and inorganic carrier, and combinations thereof.

Amine Reaction Product (ARP): For purposes of the present application, ARP is a subclass or species of pro-perfumes. One may also use "reactive" polymeric amines in which the amine functionality is pre-reacted with one or more PRMs to form an amine reaction product (ARP). Typically the reactive amines are primary and/or secondary amines, and may be part of a polymer or a monomer (non-polymer). Such ARPs may also be mixed with additional PRMs to provide benefits of polymer-assisted delivery and/or amine-assisted delivery. Nonlimiting examples of polymeric amines include polymers based on polyalkylimines, such as polyethyleneimine (PEI), or polyvinylamine (PVAm). Nonlimiting examples of monomeric (non-polymeric) amines include hydroxyl amines, such as 2-aminoethanol and its alkyl substituted derivatives, and aromatic amines such as anthranilates. The ARPs may be premixed with perfume or added separately in leave-on or rinse-off applications. In another aspect, a material that contains a heteroatom other than nitrogen, for example oxygen, sulfur, phosphorus or selenium, may be used as an alternative to amine compounds. In yet another aspect, the aforementioned alternative compounds can be used in combinations with amine compounds. In yet another aspect, a single molecule may comprise an amine moiety and one or more of the alternative heteroatom moieties, for example, thiols, phosphines and selenols. The benefit may include improved delivery of perfume as well as controlled perfume release.

Nonionic Surfactants

To further improve the phase stability of the liquid fabric softener composition, said composition may comprise, based on the weight of the liquid fabric softener composition, from 0.01% to 10% of a nonionic surfactant, preferably ethoxylated nonionic surfactant, more preferably an ethoxylated nonionic surfactant having a hydrophobic lipophilic balance value of 8 to 18.

Deposition Aid

In one aspect, the liquid fabric softener composition may comprise, based on the weight of the liquid fabric softener composition, from 0.0001% to 3%, preferably from 0.0005 to 2%, more preferably from 0.001 to 1% of a deposition aid to further improve the performance of the liquid fabric softener. In one aspect, the deposition aid may be a cationic or amphoteric polymer. In one aspect, the deposition aid may be a cationic polymer. In one aspect, the cationic polymer may comprise a cationic acrylate. Cationic polymers in general and their method of manufacture are known in the literature. Deposition aids can be added concomitantly with the particles or directly in the liquid fabric softener composition. Preferably, the deposition aid is selected from the group consisting of polyvinylformamide, partially hydroxylated polyvinylformamide, polyvinylamine, polyethylene imine, ethoxylated polyethylene imine, polyvinylalcohol, polyacrylates, and combinations thereof. Even more preferably the deposition aid is partially hydroxylated polyvinylformamide.

The weight-average molecular weight of the polymer may be from 500 to 5,000,000 or from 1,000 to 2,000,000 or from 2,500 to 1,500,000 Daltons, as determined by size exclusion chromatography relative to polyethyleneoxide standards with Refractive Index (RI) detection. In one aspect, the weight-average molecular weight of the cationic polymer may be from 500 to 37,500 Daltons.

Use of Salt and Chitosan

One other aspect of the invention is the use of a combination of salt and chitosan in a liquid fabric softener composition to provide improved phase stability and/or viscosity stability. Preferably said salt is selected from the group consisting of alkaline metals salts, alkaline earth metal salts of the mineral acids and combinations thereof.

By "improved stability" is meant a liquid fabric softener composition having a viscosity loss of less than 50% in 1 month storage at 50° C.

Processes of Making the Liquid Fabric Softener Composition of the Invention

The liquid fabric softener composition of the present invention can be formulated into any suitable form and prepared by any process chosen by the formulator, non-limiting examples of which are described in Applicants examples and in US 2013/0109612 A1 which is incorporated herein by reference.

The liquid fabric softener composition disclosed herein may be prepared by combining the components thereof in any convenient order and by mixing, e.g., agitating, the resulting component combinations to form a phase stable fabric and/or home care composition. In one aspect, a fluid matrix may be formed containing at least a major proportion, or even substantially all, of the fluid components with the fluid components being thoroughly admixed by imparting shear agitation to this liquid combinations. For example, rapid stirring with a mechanical stirrer may be employed.

Method of Use

The liquid fabric softener composition of the present invention may be used in any conventional manner. In short, they may be used in the same manner as products that are designed and produced by conventional methods and processes. For example, liquid fabric softener compositions of the present invention can be used to treat fabric. Typically at least a portion of the fabric is contacted with an aspect of Applicants' composition diluted in a wash liquor, and then the fabric is rinsed. For purposes of the present invention, washing includes but is not limited to, scrubbing, and mechanical agitation. The fabric may comprise any fabric capable of being laundered in normal consumer use conditions. When the wash solvent is water, the water temperature typically ranges from 5° C. to 90° C. and the water to fabric mass ratio is typically from 1:1 to 100:1.

Methods

Method for Determining Dynamic Yield Stress

Dynamic yield stress is measured using a controlled stress rheometer (such as an HAAKE MARS from Thermo Scientific, or equivalent), using a 60 mm parallel plate and a gap size of 500 microns at 20° C. The dynamic yield stress is obtained by measuring quasi steady state shear stress as a function of shear rate starting from 10 $s^{-1}$ to $10^{-4}$ $s^{-1}$, taking 25 points logarithmically distributed over the shear rate range. Quasi-steady state is defined as the shear stress value once variation of shear stress over time is less than 3%, after at least 30 seconds and a maximum of 60 seconds at a given shear rate. Variation of shear stress over time is continuously evaluated by comparison of the average shear stress measured over periods of 3 seconds. If after 60 seconds measurement at a certain shear rate, the shear stress value varies more than 3%, the final shear stress measurement is defined as the quasi state value for calculation purposes. Shear stress data is then fitted using least squares method in logarithmic space as a function of shear rate following a Herschel-Bulkley model:

$$\tau=\tau_0\pm k\dot{\gamma}^n$$

wherein $\tau$ is the measured equilibrium quasi steady state shear stress at each applied shear rate $\dot{\gamma}$. $\tau_0$ is the fitted dynamic yield stress. k and n are fitting parameters.

Method of Measuring Iodine Value of a Quaternary Ammonium Ester Fabric Softening Active The iodine value of a quaternary ammonium ester fabric softening active is the iodine value of the parent fatty acid from which the fabric softening active is formed, and is defined as the number of grams of iodine which react with 100 grams of parent fatty acid from which the fabric softening active is formed.

First, the quaternary ammonium ester fabric softening active is hydrolysed according to the following protocol: 25 g of fabric softener composition is mixed with 50 mL of water and 0.3 mL of sodium hydroxide (50% activity). This mixture is boiled for at least an hour on a hotplate while avoiding that the mixture dries out. After an hour, the mixture is allowed to cool down and the pH is adjusted to neutral (pH between 6 and 8) with sulfuric acid 25% using pH strips or a calibrated pH electrode.

Next the fatty acid is extracted from the mixture via acidified liquid-liquid extraction with hexane or petroleum ether: the sample mixture is diluted with water/ethanol (1:1) to 160 mL in an extraction cylinder, 5 grams of sodium chloride, 0.3 mL of sulfuric acid (25% activity) and 50 mL of hexane are added. The cylinder is stoppered and shaken for at least 1 minute. Next, the cylinder is left to rest until 2 layers are formed. The top layer containing the fatty acid in hexane is transferred to another recipient. The hexane is then evaporated using a hotplate leaving behind the extracted fatty acid.

Next, the iodine value of the parent fatty acid from which the fabric softening active is formed is determined following ISO3961:2013. The method for calculating the iodine value of a parent fatty acid comprises dissolving a prescribed amount (from 0.1-3 g) into 15 mL of chloroform. The dissolved parent fatty acid is then reacted with 25 mL of iodine monochloride in acetic acid solution (0.1M). To this, 20 mL of 10% potassium iodide solution and 150 mL deionised water is added. After the addition of the halogen has taken place, the excess of iodine monochloride is determined by titration with sodium thiosulphate solution (0.1M) in the presence of a blue starch indicator powder. At the same time a blank is determined with the same quantity of reagents and under the same conditions. The difference between the volume of sodium thiosulphate used in the blank and that used in the reaction with the parent fatty acid enables the iodine value to be calculated.

Method of Determining Viscosity of a Fabric Softener Composition

The viscosity of neat fabric softener composition is determined using a Brookfield® DV-E rotational viscometer, at 60 rpm, at 21° C. Spindle 2 is used for viscosities from 50 mPa·s to 400 mPa·s. Spindle 3 is used for viscosities from 401 mPa·s to 2.0 Pa·s.

Method of Measuring the Molecular Weight of Chitosan

Chitosan samples (1 mg/mL) are dissolved in AcOH/$AcNH_4$ buffer (pH 4.5) and then filtered on 0.45 μm pore size membrane (Millipore). Size-exclusion chromatography is performed by means of an LC pump (Agilent Technologies 1260 Infinity) on two serially connected columns (TSK G2500-PW and TSK G6000-PW Tosoh Bioscience). The detection is operated by a differential refractometer (Wyatt Optilab T-rex) coupled on-line with a MALS detector (Wyatt Dawn Heleos II). A degassed $AcOH/AcNH_4$ buffer (pH 4.5) is used as eluent after two filtrations on 0.22 μm pore size membrane (Millipore). The flow rate is maintained at 0.5 mL/min, and the amount of sample injected is 100 μL. Chromatograms are analyzed by the Wyatt Astra software (version 6.1.2).

Method to Quantify Encapsulated Perfume in Capsules.

To determine the identity and to quantify the weight of perfume, perfume ingredients, or Perfume Raw Materials (PRMs), encapsulated within the capsules, Gas Chromatography with Mass Spectroscopy/Flame Ionization Detector (GC-MS/FID) is employed. Suitable equipment includes: Agilent Technologies G1530A GC/FID; Hewlett Packard Mass Selective Device 5973; and 5%-Phenyl-methylpolysiloxane Column J&W DB-5 (30 m length×0.25 mm internal diameter×0.25 μm film thickness). Approximately 3 g of the finished product or suspension of delivery particles, is weighed and the weight recorded, then the sample is diluted with 30 mL of deionised water and filtered through a 5.0 μm pore size nitrocellulose filter membrane. Material captured on the filter is solubilized in 5 mL of a ISTD solution (25.0 mg/L tetradecane in anhydrous alcohol), and heated at 60° C. for 30 minutes. The cooled solution is filtered through a 0.45 μm pore size PTFE syringe filter and analyzed via Gas Chromatography with Mass Spectrometer detector/Flame Ionization Detector (GC-MS/FID). Three known perfume oils are used as comparison reference standards. Data Analysis involves summing the total area counts minus the ISTD area counts, and calculating an average Response Factor (RF) for the 3 standard perfumes. Then the Response Factor and total area counts for the product encapsulated perfumes are used along with the weight of the sample, to determine the total weight percent for each PRM in the encapsulated perfume. PRMs are identified from the mass spectrometry peaks.

EXAMPLES

Examples 1-4: Liquid Fabric Softener Compositions

The liquid fabric softener compositions of examples 1-4 were prepared as described below. Water, chelant, HCl, formic acid were mixed together in a plastic beaker with a blade mixer. This aqueous solution was heated up in 1 liter plastic bottle in an oven at 65° C. The fabric softener active (Diethyloxyester dimethyl ammonium chloride—DEEDMAC) was heated up in an oven at 85° C. The aqueous solution was mixed with a rushton mixer in a baffled 2 liter tank at a temperature of 63-64° C. The fabric softener active directly coming from the oven was injected with a syringe into the hot water. The obtained dispersion was cooled down by letting it rest in a room at 21° C. The additional ingredients were added to the dispersion using a high shear mixer at 8,000 RPM for 15 seconds. The added structurant is either Chitosan (448877 Sigma Aldrich) or a conventional structurant.

In comparative examples 1 and 2, no $CaCl_2$) was added and Perfume A was added.

In comparative example 3 and inventive example 4 $CaCl_2$) was added at a level of 0.005%, perfume B and encapsulated benefit agent (perfume capsules) were added. The viscosity was measured two times, the first time right after the composition is made (fresh) and a second time one month (at 50° C.) after the making of the composition.

TABLE 1

Liquid fabric softener compositions Examples 1-4. Examples 1-3 are comparative examples.

| | (weight percent) | | | |
|---|---|---|---|---|
| Ingredients | 1 Comparative | 2 Comparative | 3 Comparative | 4 Inventive |
| NaHEDP Chelant | 0.0068 | 0.0068 | 0.0069 | 0.0069 |
| Formic Acid | 0.043 | 0.043 | 0.024 | 0.024 |
| Hydrochloric acid | 0.0084 | 0.0084 | 0.011 | 0.011 |
| Preservative[1] | 0.022 | 0.022 | 0.036 | 0.036 |
| DEEDMAC[2] | 5.65 | 5.65 | 8.55 | 8.55 |
| Silicone antifoam[3] | 0.097 | 0.097 | 0.098 | 0.098 |
| $CaCl_2$ | — | — | 0.005 | 0.005 |
| Liquitint Blue dye | 0.0230 | 0.0230 | 0.007 | 0.007 |
| Liquitint Violet dye | 0.0040 | 0.0040 | — | — |
| Liquitint Red dye | — | — | 0.0015 | 0.0015 |
| Perfume A | 3.29 | 3.29 | — | — |
| Perfume B | — | — | 2.3 | 2.3 |
| Encapsulated benefit agent slurry[4] | — | — | 0.61 | 0.61 |
| $MgCl_2$[5] | — | — | 0.0036 | 0.0036 |
| Conventional structurant[6] | 0.29 | — | 0.31 | — |
| Chitosan[7] | — | 0.29 | — | 0.15 |
| Water | balance | balance | balance | balance |
| Viscosity at 10/s - Fresh (mPa · s)[8] | 245 | 248 | 364 | 317 |
| Viscosity at 10/s - 1 month 50° C. (mPa · s)[8] | 79 | 112 | 125 | 220 |
| % viscosity loss | 67.8 | 54.8 | 65.7 | 30.6 |

[1]Proxel GXL supplied by Lonza, 20% activity

[2]Reaction product of Methyl-diethanolamine with fatty acids, in molar ratio ranging from 1:1.5 to 1:2, quaternized with methylchloride. The fatty acid has a chain length distribution of 35-55% saturated C18 chains, 10-25% mono-unsaturated C18 chains, and has an iodine value of 20. The product contains 9% isopropanol and is supplied by Evonik

[3]Xiameter AFE-2010, supplied by Dow, 8% silicone content

[4]Suitable melamine formaldehyde based perfume capsules can be purchased from Encapsys (825 East Wisconsin Ave, Appleton, WI 54911), and are made as follows: 25 grams of butyl acrylate-acrylic acid copolymer emulsifier (Colloid C351, 25% solids, pka 4.5-4.7, (Kemira Chemicals, Inc. Kennesaw, Georgia U.S.A.)) is dissolved and mixed in 200 grams deionized water. The pH of the solution is adjusted to pH of 4.0 with sodium hydroxide solution. 8 grams of partially methylated methylol melamine resin (Cymel 385, 80% solids, (Cytec Industries West Paterson, New Jersey, U.S.A.)) is added to the emulsifier solution. 200 grams of perfume oil is added to the previous mixture under mechanical agitation and the temperature is raised to 50° C. After mixing at higher speed until a stable emulsion is obtained, the second solution and 4 grams of sodium sulfate salt are added to the emulsion. This second solution contains 7 grams of butyl acrylate-acrylic acid copolymer emulsifier (Colloid C121, 25% solids, Kemira), 120 grams of distilled water, sodium hydroxide solution to adjust pH to 4.8, 25 grams of partially methylated methylol melamine resin (Cymel 385, 80% solids, Cytec). This mixture is heated to 85° C. and maintained overnight with continuous stirring to complete the encapsulation process. 23 grams of acetoacetoamide (Sigma-Aldrich, Saint Louis, Mo USA) are added. A volume-mean particle size of 18 microns is obtained. Then perfume capsules are coated with a polyvinylformamide deposition aid as follows: 0.5 grams of a cationic modified copolymer of polyvinylamine and N-vinyl formamide (BASF Corp) is added.

[5]MgCl2 added with the perfume capsules slurry

[6]Rheovis CDE, supplied by BASF

[7]Chitosan - (448877 Sigma Aldrich)

[8]Brookfield ® DV-E viscosity in mPa · s, measured at 60 rpm with spindle 2, at 21° C.

As illustrated in Table 1, in a liquid fabric softener composition, the combinations of a conventional structurant with no salt (example 1) compared to the combinations of the same conventional structurant with added salt (example 3) did not make a meaningful difference in viscosity loss over time (only 2% difference).

However, a synergistic effect in example 4 was observed with the combinations of chitosan and salt in a liquid fabric softener composition. Example 4 according to the present invention exhibits less viscosity loss over time compared to the compositions of the comparative examples:

37.2% less viscosity loss in 1 month than the composition of example 1 (conventional structurant and no added salt).

24.2% less viscosity loss in 1 month than the composition of example 2 (chitosan and no added salt).

35.1% less viscosity loss in 1 month than the composition of example 3 (conventional structurant and added salt).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition of the same term in a document incorporated by reference, the meaning of definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid fabric softener composition comprising, based on the weight of the liquid fabric softener composition:

a) from about 4% to 15% of fabric softening active, wherein the fabric softening active is an ester quaternary ammonium compound;

b) from about 0.01% to about 1% of chitosan;

c) from about 0.002% to about 2% of salt, wherein the salt is selected from the group consisting of $CaCl_2$, NaCl, $MgCl_2$, and combinations thereof; and d) from about 0.1% to about 6% of dispersed perfume oil;

wherein the liquid fabric softener is free of a conventional structurant, and wherein the liquid fabric softener is characterized by a viscosity loss of less than 50% in 1 month storage at 50° C.

2. The liquid fabric softener composition according to claim 1 the quaternary ammonium compound has the following formula:

$$\{R^2_{(4-m)}—N+—[X—Y—R^1]_m\}A^-$$

wherein:

m is 1, 2 or 3 with proviso that the value of each m is identical;

each $R^1$ is independently hydrocarbyl, or branched hydrocarbyl group;

each $R^2$ is independently a $C_1$-$C_3$ alkyl or hydroxyalkyl group;

each X is independently $—(CH_2)_n—$, $—CH_2—CH(CH_3)—$ or $—CH—(CH_3)—CH_2—$ and each n is independently 1, 2, 3 or 4;

each Y is independently —O—(O)C— or —C(O)—O—;

$A^-$ is independently selected from the group consisting of chloride, methyl sulfate, and ethyl sulfate;

with the proviso that when Y is —O—(O)C—, the sum of carbons in each $R^1$ is from about 13 to about 21.

3. The liquid fabric softener composition according to claim 1, wherein the chitosan has a molecular weight from about 10,000 g/mol to about 4,000,000 g/mol.

4. The liquid fabric softener composition according to claim 1, comprising, based on the weight of the liquid fabric softener composition, from about 0.005% to about 0.5% of said salt.

5. The liquid fabric softener composition according to claim 1, comprising, based on the weight of the liquid fabric softener composition, from about 0.02% to about 5%, of particles selected from the group consisting of beads, encapsulated benefit agent, pearlescent agents and combinations thereof.

6. The liquid fabric softener composition according to claim 5, wherein the encapsulated benefit agent is a perfume composition.

7. The liquid fabric softener composition according to claim 6, wherein said perfume composition is encapsulated in capsules and said capsules comprise a capsule shell, the capsule shell comprising one or more wall materials comprising melamine, polyacrylate and combinations thereof.

8. The liquid fabric softener composition according to claim 5, further comprising about 0.001 to about 1% of a deposition aid, said deposition aid is selected from the group consisting of polyvinylformamide, partially hydroxylated polyvinylformamide, polyvinylamine, polyethylene imine, ethoxylated polyethylene imine, polyvinylalcohol, polyacrylates, and combinations thereof.

9. The liquid fabric softener composition according to claim 1, comprising, based on the weight of the liquid fabric softener composition, from about 0.01% to about 10% of a nonionic surfactant.

10. The liquid fabric softener composition according to claim 1, wherein the liquid fabric softener composition has a dynamic yield stress at about 20° C. from about 0.001 Pa to about 1.0 Pa.

11. The liquid fabric softener composition according to claim 1, having a viscosity at about 21° C. of from about 50 mPa·s to about 800 mPa·s as measured with a rotational viscometer, spindle 2 for viscosities between 50 mPa·s and about 400 mPa·s, spindle 3 for viscosities between 401 mPa·s and 800 mPa·s, at 60 rpm, at about 21° C.

12. The liquid fabric softener composition according to claim 1, wherein the salt comprises $MgCl_2$.

13. The liquid fabric softener composition according to claim 1, wherein the salt comprises $CaCl_2$.

14. The liquid fabric softener composition according to claim 1, wherein the salt comprises $MgCl_2$ and $CaCl_2$.

15. The liquid fabric softener composition according to claim 1, wherein the salt is present at a level of from about 0.01% to 0.3%, based on the weight of the liquid fabric softener composition.

* * * * *